US006979284B2

(12) United States Patent
Curtis

(10) Patent No.: US 6,979,284 B2
(45) Date of Patent: Dec. 27, 2005

(54) EXERCISE APPARATUS

(76) Inventor: James Curtis, 7260 NW. Sale Barn Rd., Cameron, MO (US) 64429

( * ) Notice: Subject to any disclaimer, the term of this patent is extended or adjusted under 35 U.S.C. 154(b) by 127 days.

(21) Appl. No.: 10/649,569

(22) Filed: Aug. 26, 2003

(65) Prior Publication Data

US 2004/0038781 A1 Feb. 26, 2004

Related U.S. Application Data

(60) Provisional application No. 60/405,804, filed on Aug. 26, 2002.

(51) Int. Cl.[7] ..... A63B 22/06
(52) U.S. Cl. ..... 482/57; 482/62; 482/130; 297/217.1
(58) Field of Search ..... 482/57, 62, 73, 482/112, 123, 128, 130, 133, 138, 142, 908, 482/910; 297/217.1, 17, 188.01

(56) References Cited

U.S. PATENT DOCUMENTS 1,969,901 A * 8/1934 Pilates ..... 482/130
3,738,649 A 6/1973 Miller
4,805,901 A * 2/1989 Kulick ..... 482/63
4,913,423 A * 4/1990 Farran et al. ..... 482/130
4,921,247 A * 5/1990 Sterling ..... 482/138
4,974,840 A * 12/1990 Welch ..... 482/133
5,470,298 A * 11/1995 Curtis ..... 482/130
5,672,141 A * 9/1997 Johnston ..... 482/57
6,368,260 B1 * 4/2002 Crews ..... 482/142

* cited by examiner

*Primary Examiner*—Danton D. DeMille
*Assistant Examiner*—Tam Nguyen

(57) ABSTRACT

An exercise apparatus is provided which includes a chair, an arm-exercising station, and a leg-exercising station. The arm-exercising station is mounted in the armrests of the chair and includes a support frame attached to the base portion of the chair, a pair of elongated left and right exercise bars disposed within the left and right armrest portions of the chair operable for selective pivotal movement within the armrest portions, and a resistance device attached to the bars for resisting the pivotal movement of the bars. The leg-exercising station is associated with the underside of the footrest portion of the chair and includes a pedal assembly configured for rotational movement. The pedal assembly is automatically raised and positioned for use when the footrest is pivoted forwardly. The leg-exercising station is concealed within the chair when not in use.

1 Claim, 5 Drawing Sheets

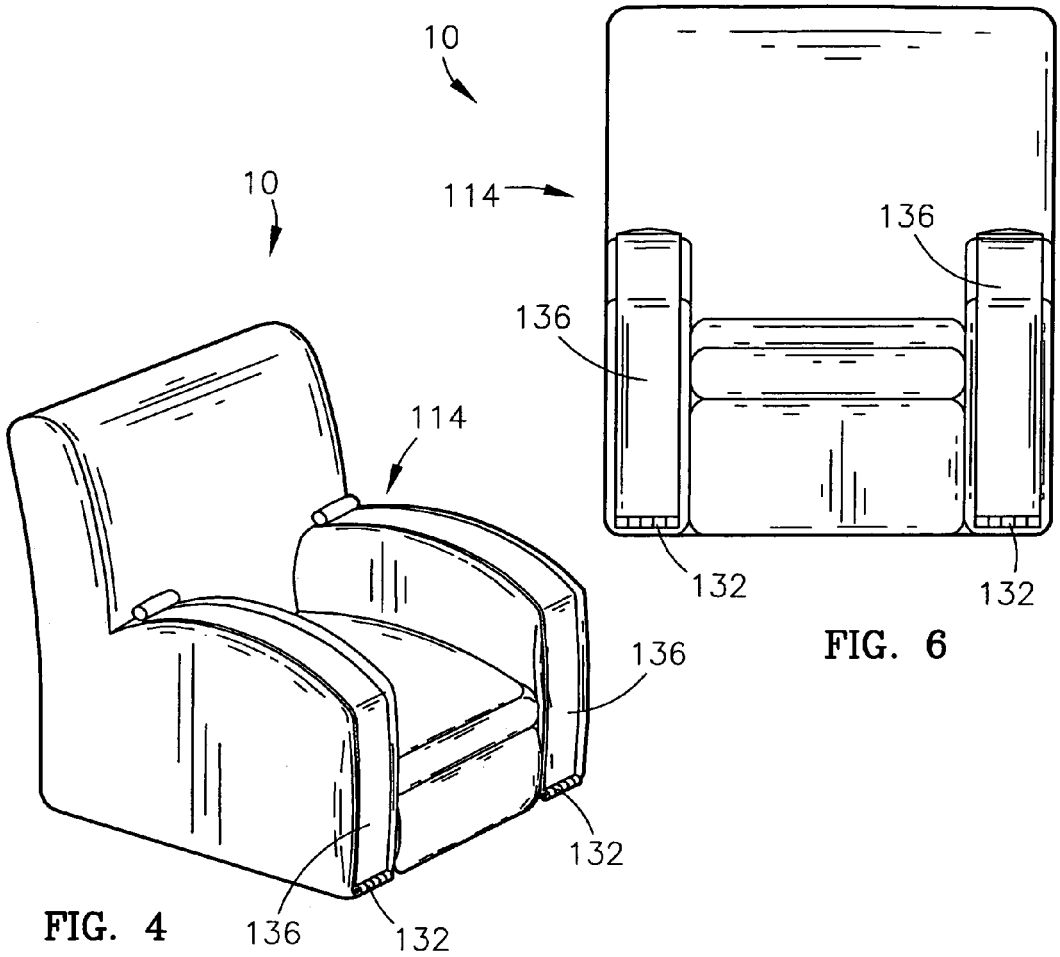
FIG. 6
FIG. 4
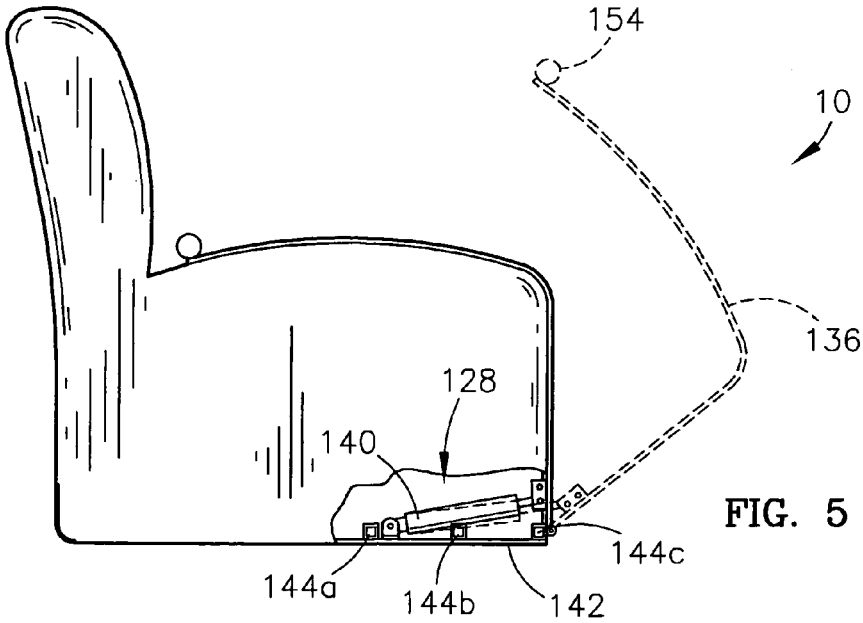
FIG. 5

EXERCISE APPARATUS

RELATED APPLICATIONS

The present non-provisional patent application claims priority benefit, with regard to all common subject matter, of a copending U.S. provisional patent application titled FINAL EXERCISER, Ser. No. 60/405,804, filed Aug. 26, 2002. The identified provisional application is hereby incorporated by reference into the present application.

BACKGROUND OF THE INVENTION

1. Field of the Invention

The present invention relates generally to exercise equipment and, more particularly, to an exercise apparatus which is incorporated in a piece of furniture such as a chair or recliner.

2. Description of the Prior Art

Due to increased public interest in fitness and health, a great variety of exercise equipment has been designed in recent years. Most such exercise equipment includes either a weight-resistance apparatus, a cycle apparatus, or both. Most of these prior art exercise devices are large and bulky and thus require a significant amount of floor space. Moreover, prior art equipment is typically manufactured with numerous moving parts formed of tubular steel or rubber and is therefore unsightly. Accordingly, most prior art exercise equipment is primarily designed to be used in commercial fitness centers. Since many users are too busy to travel to fitness centers, commercial exercise equipment is often underutilized.

To meet the demand for more convenient exercise equipment, manufacturers have designed smaller units for residential use. Although these prior art devices are more convenient than large commercial devices, they suffer from many of the same limitations. For example, prior art residential exercisers are unattractive and too large to be placed in living areas of the home. Thus, the equipment is relegated to the basement where it is either used infrequently or totally forgotten.

It is known to design exercise equipment which is incorporated into otherwise conventional furniture to overcome the aforementioned disadvantages. For example, U.S. Pat. No. 3,738,649 discloses a combined chair and exercising device which has exercise equipment mounted on a platform in a space beneath the seat portion. Although exercise equipment of this type is more convenient than conventional exercise equipment, it presents several disadvantages of its own. For example, prior art furniture exercisers must be set-up before use. In the '649 patent, the user must first get up from the chair and position and lock the exercise platform outside the seat portion of the chair. This operation is cumbersome and time-consuming and thus limits the convenience of the equipment, especially for senior users. A second limitation of prior art furniture exercisers is that they provide limited exercise operations and do not allow the user to exercise his or her upper and lower body simultaneously. A third limitation of prior art furniture exercisers, such as the apparatus disclosed in U.S. Pat. No. 5,470,298, is that they require the user to bend, stoop, lift, or otherwise awkwardly exert themselves in order to expose or access the normally concealed exercise mechanisms. Many users, including the elderly or the disabled, may be incapable of the actions required to place the exerciser in position for use.

Due to these and other problems and disadvantages in the prior art, a need exists for an improved exercise apparatus.

SUMMARY OF THE INVENTION

It is an object of the present invention to provide an exercise apparatus which is sized for convenient and attractive use in any room of a residence.

It is another object of the present invention to provide an exercise apparatus which doubles as a useful piece of furniture.

It is another object of the present invention to provide an exercise apparatus that is more easily and conveniently set-up or placed in position or condition for use.

It is another object of the present invention to provide an exercise apparatus that can be used without requiring the user to perform time-consuming, cumbersome, and awkward set-up procedures, or require the user to kneel, lift, or undertake other physically demanding tasks to prepare the exercise apparatus for use.

It is another object of the present invention to provide an exercise apparatus which allows the user to effectively exercise his or her upper and lower body simultaneously.

In accordance with these and other objects evident from the following description of a preferred embodiment of the present invention, an exercise apparatus is provided which broadly comprises a chair having a base portion, a seat portion, a footrest portion and footrest support structure, a backrest portion, and a pair of left and right armrest portions; an arm-exercising station; and a leg-exercising station. The chair may be otherwise conventional or conventional appearing (e.g., an upholstered recliner-type chair). The footrest support structure is conventionally extendable so as to position the footrest in a forward position and retractable so as to position the footrest in a stowed position.

The arm-exercising station is mounted within the armrests of the chair and broadly includes a support frame attached to the base portion of the chair, a pair of elongated left and right exercise bars operable for selective pivotal movement within the armrest portions, and a resistance device attached to the bars for resisting movement of the bars within the armrest portions of the chair. The exercise bars include a structure which allows the user to adjust the resistance of the resistance device while the exercise equipment is in use.

The leg-exercising station is associated with an underside portion of the chair's footrest. The footrest is pivotally attached to the footrest support structure by a hinge or similar mechanism which allows the footrest to pivot forwardly in order to expose and automatically raise the leg-exercising station for use. The footrest can be pivoted forwardly by pushing it with a toe or heel portion of a foot while otherwise comfortably seated. The leg-exercising station is concealed within the chair when the footrest is in its stowed position, and is substantially concealed beneath the footrest when the footrest is in its forward position but not pivoted to expose the leg-exercising station.

The leg-exercising station broadly includes a floor support and a pedal assembly. The floor support includes a pair of pivot points which are aligned and cooperate such that the floor support unfolds and extends to the floor when the footrest support structure is extended and folds and retracts into the chair when the footrest support structure is retracted.

The pedal assembly is coupled with the underside of the footrest by a chain, wire, or other flexible connection such that pivoting the footrest forwardly exposes and automatically raises the pedal assembly for use. Thus, the present invention advantageously eliminates the awkward bending, stooping, or lifting required by prior art exerciser. The pedal assembly includes substantially conventional pedals configured for rotational movement. The pedal assembly is supported by the footrest support structure and the floor support. The pedal assembly may include a braking element, such as a rotational dampening mechanism, to create a resistence to the rotation of the pedal or pedals and increase the difficulty of the exercise.

By providing an exercise apparatus with this construction, numerous advantages are obtained. For example, the combination of both a leg and arm exerciser in one piece of exercise equipment provides better fitness conditioning with reduced space requirements. Additionally, since the exercise apparatus doubles as a useful piece of furniture, it can be attractively placed in any area of a home. Accordingly, the exercise apparatus is more convenient and will be used more frequently. Additionally, the user can use the exercise apparatus without first rising from the chair and performing time-consuming, cumbersome, and awkward set-up procedures and without stooping or kneeling in an awkward or uncomfortable position. Once again, this increases the convenience and usage of the exercise apparatus. Finally, the construction of the arm-exerciser allows the user to adjust the resistance of the exercise movement "on-the-fly". This also increases the convenience of the exercise apparatus.

BRIEF DESCRIPTION OF THE DRAWING FIGURES

A preferred embodiment of the present invention is described in detail below with reference to the attached drawing figures, wherein:

FIG. 4 is a perspective view of the exercise apparatus showing a preferred second embodiment of an arm exercising station;

FIG. 5 is a side view of the exercise apparatus of FIG. 4;

FIG. 6 is a front view of the exercise apparatus of FIG. 4;

DETAILED DESCRIPTION OF THE PREFERRED EMBODIMENTS

Figure 1:
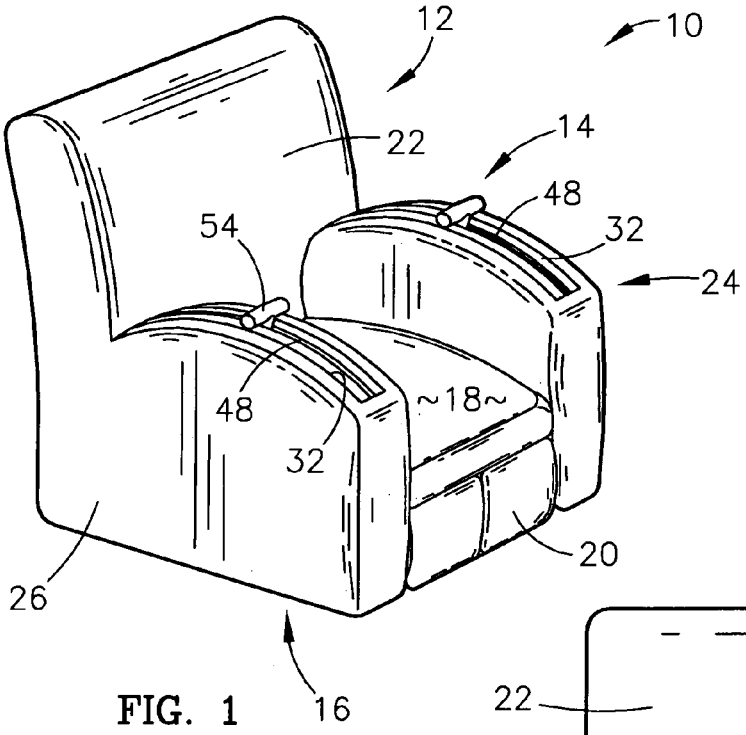
FIG. 1 is a perspective view of an exercise apparatus constructed in accordance with a preferred embodiment of the present invention.
Figure 3:
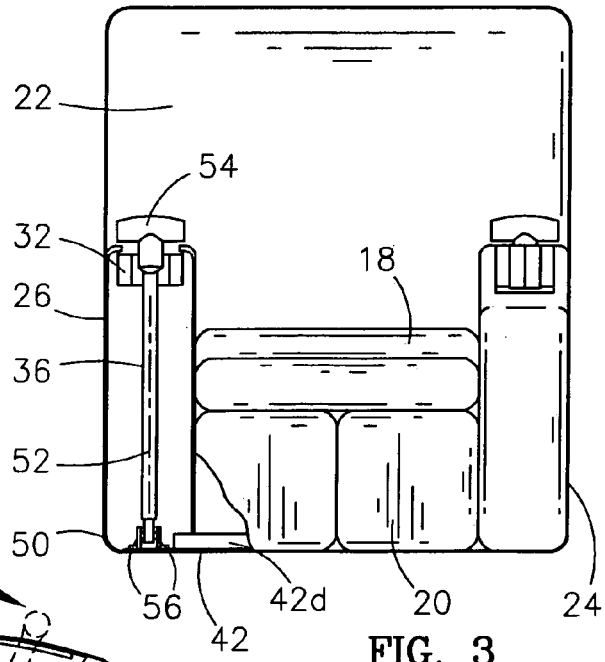
FIG. 3 is a front view of the apparatus.
Figure 7:
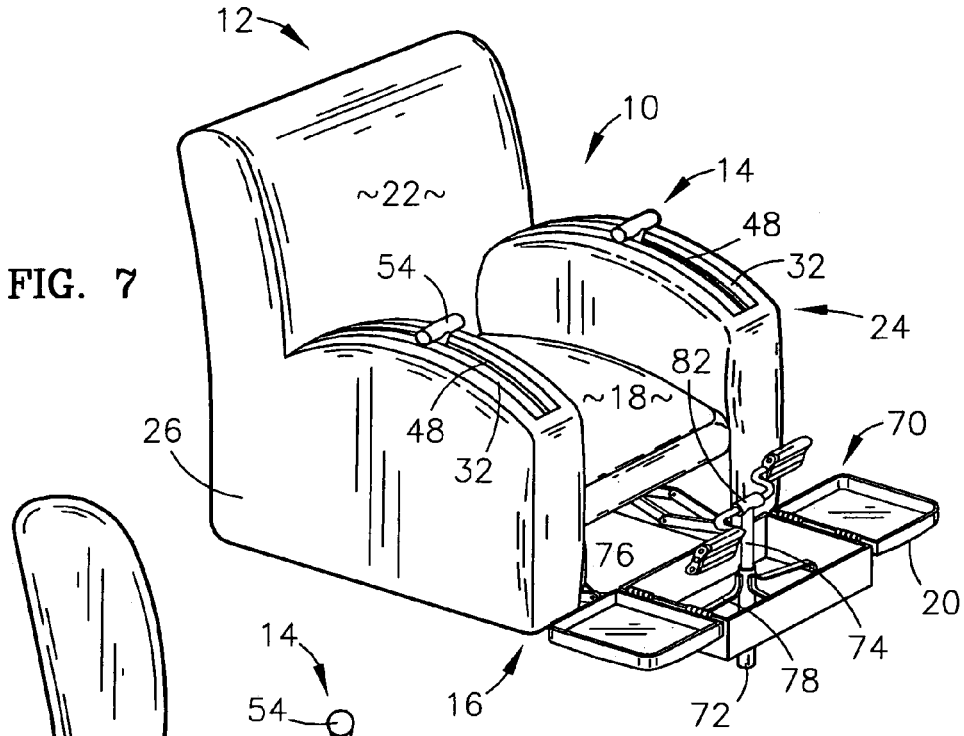
FIG. 7 is perspective view of the exercise apparatus showing a preferred first embodiment of a leg-exercising station.

Turning now to the drawings, and particularly FIG. 1, an exercise apparatus 10 constructed in accordance with the preferred embodiment is illustrated. The exercise apparatus 10 broadly includes a chair 12 and an arm-exercising station 14. As illustrated in FIG. 7, the exercise apparatus 10 also includes a leg-exercising station 70.

In more detail, the chair 12 is a substantially conventional chair or recliner and is adapted to cooperate with the components of the arm-exercising station 14 and the leg-exercising station 70 as described in detail below. As best illustrated in FIG. 1, the chair broadly includes a base portion 16, a seat portion 18, a footrest portion 20 having an underside portion 21, a backrest portion 22, and a pair of left and right armrest portions 24 and 26, respectively. An extendable footrest support structure 27 connects the chair 12 to the footrest 20. The footrest support structure 27 may be selectively extended to a forward position through conventional means as provided in a conventional chair or recliner. The footrest support structure 27 is in a rearward position when not extended.

The arm-exercising station 14 is mounted within the armrests of chair 12 and broadly includes a support frame 28, a pair of left and right rubber gussets 32, a pair of elongated left and right exercise bars 36, and a pair of left and right resistance devices 40. The support frame 28 is attached to the chair base portion 16 and provides structural support for the remaining elements of the arm-exercising station 14. The support frame 28 includes a pair of elongated left and right side margins 42 and a plurality of tubular cross members 44*a,* 44*b,* 44*c,* and 44*d.* The side margins 42 are preferably formed of flattened ⅛ inch steel plates and are rigidly attached to each side of the chair base portion 16 by conventional attachment devices. The tubular cross members 44*a–d* are preferably formed of hollow, square tubular steel having an exemplary width of one inch. The cross members are spaced apart and attached intermediate the side margins 42 to form a rigid support frame.

The left and right rubber gussets 32 are conventional elongated reinforcement strips or channels and are mounted on the top of chair armrest portions 24 and 26. As best illustrated in FIG. 1, the gussets 32 define a pair of left and right channels 48 extending substantially the entire length of the armrests. As described in detail below, the channels 48 provide a path for the pivotal movement of the left and right exercise bars 36 within the chair armrests.

The left and right exercise bars 36 are disposed within the chair left and right armrest portions 24 and 26 and are operable for selective pivotal movement therein. The exercise bars 36 are substantially identical, thus only the right exercise bar is described and shown in detail herein. The right exercise bar 36 broadly includes an inner elongated pipe 50, an outer elongated hollow tubular sleeve 52, and a handle 54.

Figure 10:
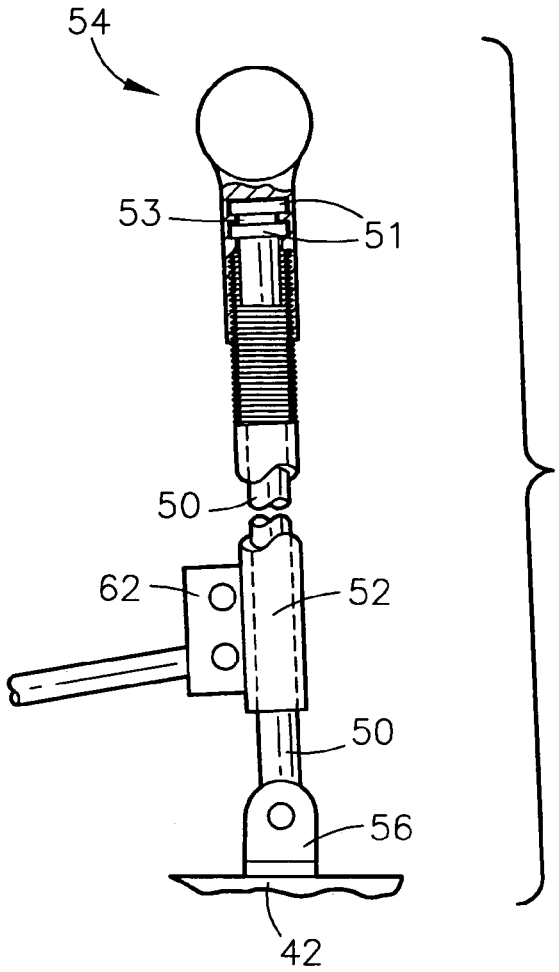
FIG. 10 is a detail view of the arm-exercising station.

As detailed in FIG. 10, the inner elongated tubular pipe 50 is preferably formed of tubular steel and presents lower and upper opposed ends. The lower end of inner pipe 50 is pivotally supported to the frame right side margin 42 by mounting bracket 56. The pivotal attachment allows the exercise bar 36 to pivot about a horizontal axis extending in a direction perpendicular to the normal direction of a person seated in the chair. Thus, the user can shift the exercise bar in a back and forth motion within channel 48 of armrest 26. The upper end of inner pipe 50 includes a pair of circumferential flanges 51 for securing the handle 54 as described below.

The outer elongated hollow tubular sleeve 52 is also preferably formed of hollow tubular steel but is of a diameter slightly greater than the diameter of the inner pipe 50. The outer sleeve is positioned concentrically around the inner pipe and is configured for axial telescopic movement about the inner pipe. The upper end of the outer sleeve 52 is threaded for engaging the internal threading of the handle 54 as described below. The lower end of the outer sleeve 52 is attached to the resistance device 40 by mounting bracket 62.

The handle 54 is a conventional handle or grip device and is rotatably mounted on the upper ends of the outer sleeve 52 and the inner pipe 50. As illustrated in FIG. 10, the handle 54 includes a base portion including an inwardly extending collar 53 which is sandwiched between the circumferential flanges 51 of the inner pipe 50. Thus, the handle 54 may be rotated freely relative to the inner pipe 50 but cannot move up or down about a vertical axis extending through the inner pipe.

The inner lower portion of the handle 54 is threaded for engaging the external threading of the outer sleeve 52. Thus, when the handle 54 is rotated relative to the inner pipe 50, the outer sleeve 52, which cannot rotate due to mounting bracket 62, telescopes outwardly from the inner pipe 50. This telescopic movement is provided to adjust the resistance of resistance device 40 as described below.

The left and right resistance devices 40 are provided for resisting the pivotal movement of exercise bars 36 within the chair armrest portions. The resistance devices 40 are substantially identical, thus only the right resistance device is described and shown in detail herein. The resistance device 40 is a conventional piston/cylinder assembly including a fixed base portion and a telescopically extending piston rod.

Figure 2:
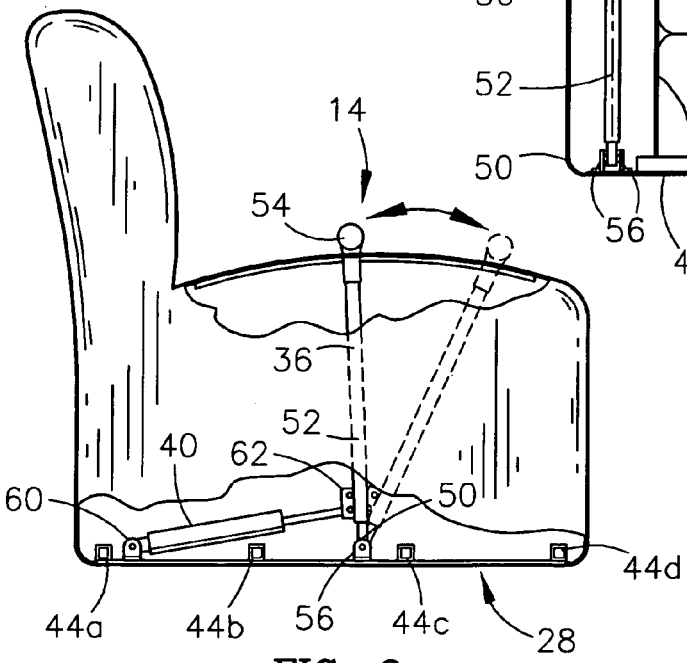
FIG. 2 is side view of the apparatus with a portion of the right armrest shown broken away.

As best illustrated in FIG. 2, the fixed base portion is a conventional hydraulic cylinder assembly and is pivotally supported to the frame right side margin 42 by mounting bracket 60. The piston rod is an elongated metal bar which telescopes in and out of the fixed base portion under tension. The distal end of the piston rod is pivotally supported to the lower end of outer sleeve 52 by mounting bracket 62. The pivotal attachment of the resistance device to the frame and to the outer sleeve prevents the sleeve from rotating but allows it to telescope upwardly from the inner pipe 50.

As described above, the apparent resistance of the resistance device 40 can be adjusted. Clockwise rotation of the handle 54 causes the outer sleeve 52 to telescope upwardly from the inner pipe 50. This upward telescopic movement of the outer sleeve 52 shifts the attachment point of the piston rod upwardly along the vertical axis of the exercise bar. As a result, the apparent resistance to the pivotal movement of the exercise bar is increased because the lever effect about the pivot point is decreased.

In use, the construction of the exercise apparatus 10 provides for a convenient and comfortable exercise operation. The user can operate the arm-exercising station 14 while sitting comfortably in the chair 12 by gripping handles 54 and repetitively pushing and pulling the exercise bars 36. The resistance of the resistance devices 40 can be increased or decreased by rotating the handles 54 in either a clockwise or counterclockwise direction.

A preferred second embodiment of the arm-exercising station 114 is illustrated in FIGS. 4–6. In this embodiment, the arm exercising station 114 includes a support frame 128, a pair of elongated L-shaped left and right exercise bars 136, and a pair of left and right resistance devices 140.

In more detail, the support frame 128 is attached to the chair base portion 16 and includes a pair of elongated left and right side margins 142 and a plurality of tubular cross members 144*a*, 144*b*, and 144*c*. The side margins 142 are preferably formed of flattened ⅛ inch steel plates and are rigidly attached to the chair base portion 16 by conventional attachment devices. The tubular cross members 144*a–c* are preferably formed of hollow, square tubular steel having an exemplary width of one inch and are spaced apart and positioned intermediate the left and right side margins 142.

The left and right exercise bars 136 are positioned atop the chair armrest portions 24 and 26 and are substantially identical. Right exercise bar 136 is preferably formed of flattened steel and presents a pair of perpendicularly opposed upper and lower L-shaped legs. The lower end of the lower leg is hingedly attached to tubular cross member 144*c* by hinge 132. The pivotal attachment allows the exercise bar to pivot about a horizontal axis extending in a direction perpendicular to the normal direction of a person seated in the chair. The right exercise bar 136 also includes a handle member 154 for gripping by the user.

The left and right resistance devices 140 are provided for resisting the pivotal movement of the exercise bars and are identical to the resistance devices 40 described above.

Figure 8:
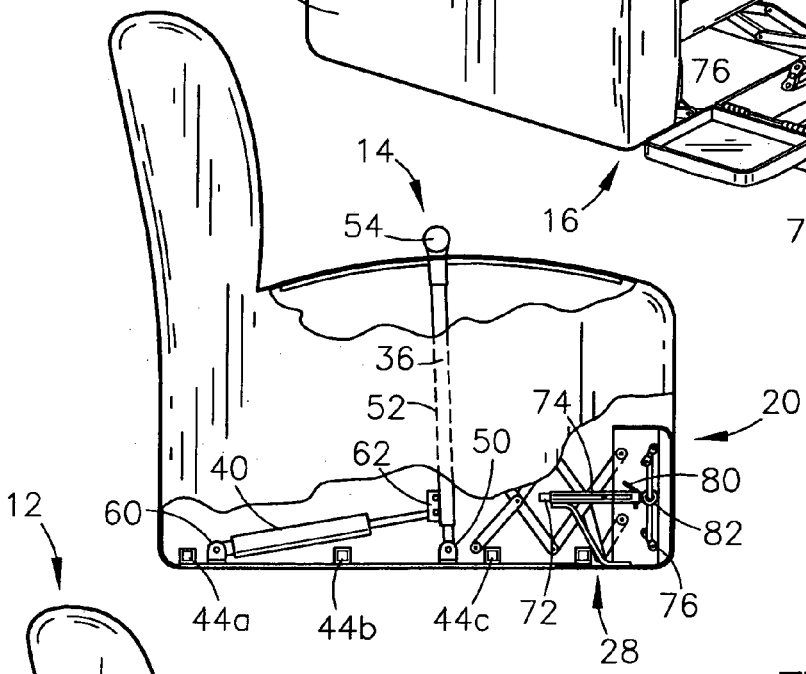
FIG. 8 is a side view of the exercise apparatus of FIG. 7 with a portion of the right armrest shown broken away.
Figure 9:
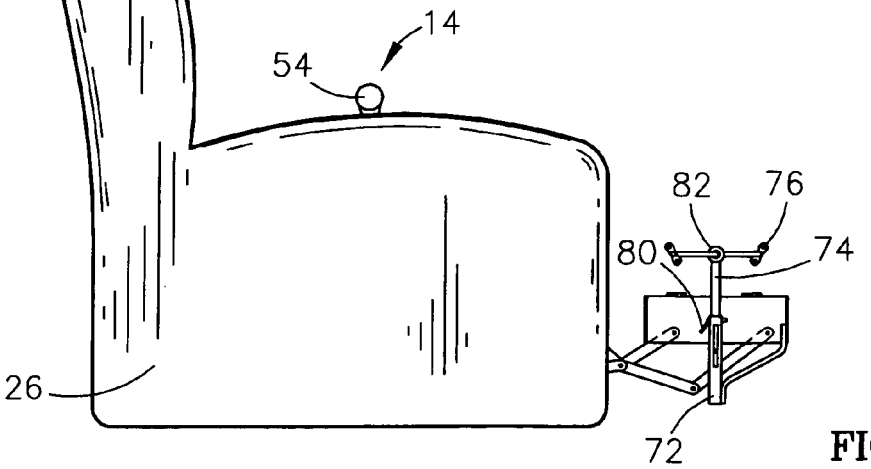
FIG. 9 is side view of the exercise apparatus of FIG. 7 illustrating the extension of the first embodiment of the leg-exerciser.

As illustrated in FIGS. 7, 8 and 9, the exercise apparatus 10 may also include a preferred first embodiment of a leg-exercising station 70 mounted within the chair footrest. As illustrated in FIG. 7, the footrest includes walls defining an open rectangular cavity for mounting the components of the leg-exercising station 70. A pair of hinged lids are provided for enclosing the leg-exercising station 70 while the exercise apparatus is being used as a conventional recliner.

The leg exercising station 70 broadly includes an elongated outer support pole 72, an elongated inner support pole 74, and a pedal assembly 76. The outer support pole 72 is preferably formed of hollow tubular steel and extends perpendicularly through the footrest portion 20. The lower end of the outer support pole 72 is positioned to engage the floor surface when the footrest 20 is fully extended. The outer support pole 72 is supported within the footrest 20 by a plurality of L-shaped support braces 78.

The inner support pole 74 is preferably formed of tubular steel, but is of a diameter smaller than the diameter of the outer pole 72. The inner pole 74 is circumferentially received in the outer pole 72 and is configured for axial telescoping movement therefrom. A locking pin 80 is provided for locking the axial position of the inner pole 74 relative to the outer pole 72.

The pedal assembly 76 is a conventional pedal apparatus and is attached to the upper end of inner pole 74. The pedal assembly is configured for rotational movement about a horizontal axis perpendicular to inner pole 74 and includes a rotational motion dampening mechanism 82 for creating a resistance to the rotational movement.

In use, the first embodiment of the leg-exercising station 70 allows a user to exercise his or her legs either independently or in conjunction with arm-exercising station 14. The user merely positions himself in chair 12 and extends footrest portion 20 in the conventional manner. Next, the pedal assembly 76 is exposed by opening the footrest hinged lids and positioning the inner pole 74 to a desired height.

Figure 11:
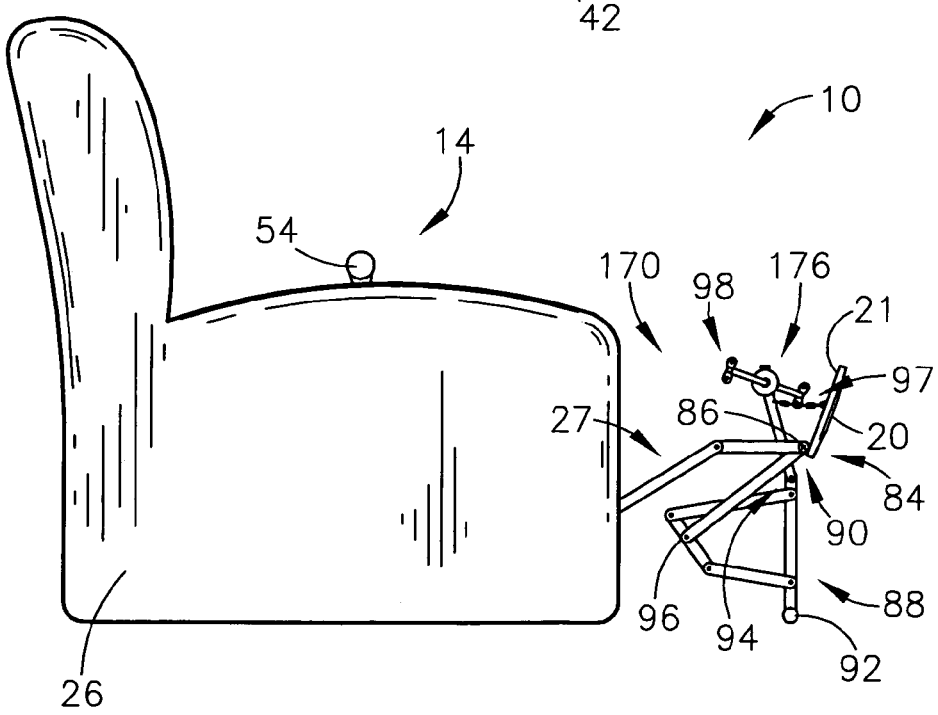
FIG. 11 is side view of the exercise apparatus showing a preferred second embodiment of the leg-exercising station, wherein the leg-exercising station is shown in its raised operating position.
Figure 12:
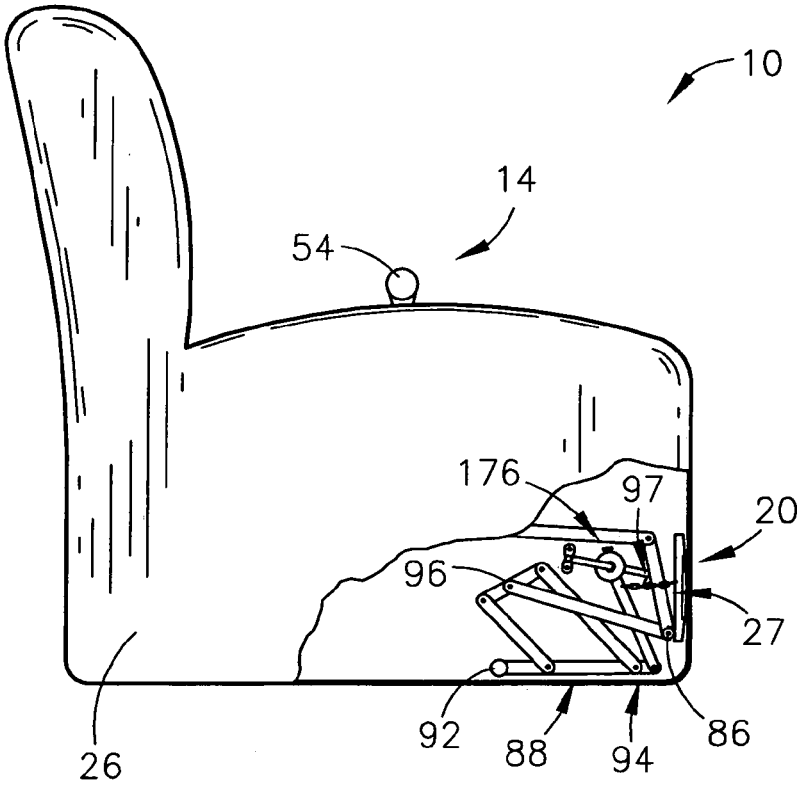
FIG. 12 is a side view of the exercise apparatus of FIG. 11 wherein the leg-exercising station is shown in its substantially hidden stowed position.
Figure 13:
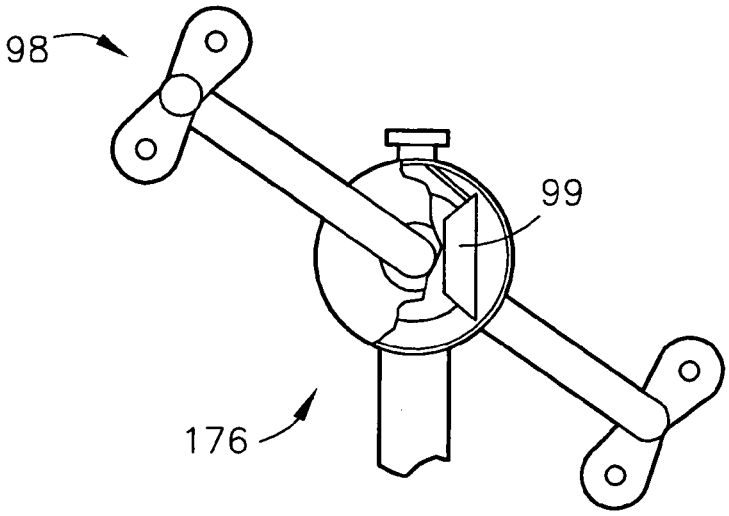
FIG. 13 is a fragmentary section view of the pedal assembly portion of the leg-exercising station of the exercise apparatus of FIG. 11.

As illustrated in FIGS. 11, 12 and 13, the exercise apparatus 10 may alternatively include a preferred second embodiment of the leg-exercising station 170 associated with an underside portion 21 of the footrest 20. The footrest support structure 27 is conventionally extendable so as to position the footrest 20 in a forward position, and retractable so as to position the footrest 20 in a stowed position. As shown in FIG. 11, the footrest 20 has a first end 84 which is pivotally attached to the extendable footrest support structure 27 using a hinge 86 or other similarly movable mechanism. The hinge 86 allows the footrest 20 to pivot upwardly and forwardly about its first end 84 to expose the underside portion 21 of the footrest 20 and, in so doing, expose and automatically raise the leg-exercising station 170 for use.

The leg-exercising station 170 includes a floor support 88 and a pedal assembly 176. The floor support 88 presents a first end 90 which is pivotally attached to the first end 84 of the footrest 20 by the hinge 86. The floor support 88 presents a second end 92 adapted to contact and rest upon the same floor or other surface as the chair 12 rests, and thereby acts to assist in supporting the weight of the pedal assembly 176. The second end 92 is preferably shaped in a manner that widely and evenly distributes any pressure transferred through the floor support 88 to the floor.

In more detail, the floor support 88 incorporates a first pivot point 94 and a second pivot point 96. The first pivot point 94 is attached to the pedal assembly 176 using conventional means. As shown in FIGS. 11 and 12, the first pivot point 94 and second pivot point 96 are aligned and cooperate such that the floor support 88 unfolds and extends to the floor when the footrest support structure 27 is extended, and folds and retracts within the base portion 16 of the chair 12 (along with the footrest support structure 27 and the pedal assembly 176) when the footrest support structure 27 is retracted. The location of the first pivot point 94 and the second pivot point 96 on the floor support 88 will vary depending on such factors as the size of the chair 12 and the desired position of the footrest 20 when in its forward position.

The pedal assembly 176 is a conventional pedal apparatus including pedals 98 that are configured for rotational movement about an axis. The pedal assembly 176 preferably includes a dampening mechanism 182 for selectively and adjustably resisting the rotational movement. The dampening mechanism 99 may be, for example, a conventional mechanical brake including a friction pad, band, or other suitable resistance mechanism. The damping mechanism 99 is adjustable by the user to set the desired level of resistance and thereby the desired level of difficulty of exercise.

The pedal assembly 176 is attached to the first pivot point 94 and the first end 84 of the footrest 20. Alternatively, the pedal assembly 176 may be connected to one or more other suitable points on the floor support 88, the footrest support structure 27, or the footrest 20 in such a manner as to allow the pedal assembly 176 to be exposed and automatically raised to its proper upright operating position when the footrest 20 is in its forward position and pivoted forwardly, and to cause the pedal assembly 176 to be substantially concealed beneath the footrest 20 when the footrest 20 is in its forward but unpivoted position. A chain, wire, or other flexible linkage 97 may be used to secure the pedal assembly 176 to the underside 21 of the footrest 20 in order to achieve the aforementioned automatic raising action. Thus, the leg-exercising station 170 is completely hidden within the chair 12 or substantially concealed beneath the footrest 20 when using the chair 12 as a conventional recliner.

In use, the preferred second embodiment of the leg-exercising station 170 allows the user to exercise his or her legs either independently or in conjunction with the arm-exercising station 14. The user merely positions himself in the chair 12 and extends the footrest 20 in a conventional manner. The user then exposes and raises the pedal assembly 176 by pivoting or flipping the footrest 20 upwardly and forwardly about the hinge 86 with his or her foot. Thus, the pedal assembly 176 is exposed quickly and easily by the user without any of the awkward lifting, stooping, or kneeling required by the prior art. The user may then use the pedals 98 to perform leg exercises, possibly adjusting the dampening mechanism 99 to increase resistance. Upon completing all desired exercises, the user may again use his other foot to pivot the footrest 20 rearwardly, thereby lowering and substantially concealing the pedal assembly 176, and thereafter retract the footrest 20 to its stowed position, thereby completely hiding the leg exercise apparatus 170 within the base portion 16 of the chair 12.

Although the invention has been described with reference to the preferred embodiment illustrated in the attached drawing figures, it is noted that equivalents may be employed and substitutions made herein without departing from the scope of the invention as described in the claims.

What is claimed is:

1. An exercise apparatus comprising:

a substantially conventional upholstered recliner-type chair having a base portion, a seat portion, a backrest portion, a pair of left and right armrest portions, a footrest having an underside portion and a footrest support structure that is selectively extendable to position the footrest in a forward position and retractable to position the footrest in a stowed position;

a leg exercising station mechanically coupled to the underside portion of the footrest and adapted to allow a user to perform a leg exercise, the leg exercising station including a pedal assembly having a pair of pedals configured for rotational movement, a dampening mechanism adapted to adjustably resist the rotational movement of the pedals and a floor support adapted to unfold so as to extend between the pedal assembly and an underlying floor surface when the foot rest support structure is extended and the pedal assembly is in use and fold up to retract within the base portion of the chair when the footrest support structure is retracted; and an arm exercise station having reciprocating handles associated with the arm rest portions and adapted to allow a user to perform an arm exercise;

wherein when exercise is desired, the footrest support structure is extended, the floor support unfolds downwardly and forwardly to provide a supplementary support structure for the footrest and pedal assembly and then the footrest is pivoted upwardly and forwardly to raise up the pedal assembly via a short chain that is connected at one end to the underside portion of the foot rest and connected at the other end to a portion of the pedal assembly such that the forward pivot of the footrest automatically raises the pedal assembly so that the user can exercise by rotating the pedals and/or moving the handles.

* * * * *